US006776359B2

(12) United States Patent
Cole et al.

(10) Patent No.: US 6,776,359 B2
(45) Date of Patent: Aug. 17, 2004

(54) SPRAY NOZZLE CONFIGURATION

(75) Inventors: John M. Cole, White Lake Township, MI (US); James C. Malloy, Ferndale, MI (US)

(73) Assignee: Kolene Corporation, Detroit, MI (US)

( * ) Notice: Subject to any disclaimer, the term of this patent is extended or adjusted under 35 U.S.C. 154(b) by 112 days.

(21) Appl. No.: 09/992,874

(22) Filed: Nov. 6, 2001

(65) Prior Publication Data

US 2003/0085306 A1 May 8, 2003

(51) Int. Cl.[7] ..... B05B 1/14

(52) U.S. Cl. ..... 239/536; 239/436; 134/104.1; 164/444; 164/485

(58) Field of Search ..... 239/536, 436; 134/104.1, 198; 164/444, 443, 485, 486

(56) References Cited

U.S. PATENT DOCUMENTS

| | | | | |
|---|---|---|---|---|
| 3,084,868 A | | 4/1963 | Faler et al. | |
| 3,126,301 A | | 3/1964 | Faler | |
| 3,617,039 A | | 11/1971 | Hiroshima et al. | |
| 3,715,236 A | | 2/1973 | Fukui et al. | |
| 3,811,305 A | * | 5/1974 | Saylors, Jr. | 72/39 |
| 4,132,393 A | * | 1/1979 | Nakamura et al. | 266/117 |
| 4,269,052 A | * | 5/1981 | Imai et al. | 72/39 |
| 4,317,685 A | | 3/1982 | Ahuja et al. | |
| 5,272,798 A | | 12/1993 | Cole et al. | |
| 5,377,398 A | | 1/1995 | Bessey | |
| 5,800,694 A | | 9/1998 | Starcevic et al. | |
| 6,385,832 B1 | * | 5/2002 | Grafe et al. | 29/81.08 |

FOREIGN PATENT DOCUMENTS

| | | |
|---|---|---|
| DE | 43 00 660 A1 | 7/1994 |
| EP | 0 601 991 A1 | 12/1993 |
| EP | 0 744 233 A2 | 5/1996 |
| GB | 217831 | 10/1923 |
| JP | 58-75403 | 4/1983 |
| JP | 10121298 | 5/1998 |
| JP | 11246982 | 9/1999 |

OTHER PUBLICATIONS

"Disk model of the dynamic Leidenfrost phenomenon", Abstract submitted for the DFD96 Meeting of The American Physical Society, Martin Rein, Aug. 5, 1996.

"Miracle Mongers and their Methods", Chapter 7, pp. 122–124, Harry Houdini, pub. 1920 by E. P. Dutton.

PCT International Search Report re Application of Kolene Corporation, Ser. No. PCT/US 00/40553, filed Mar. 8, 2000.

* cited by examiner

*Primary Examiner*—Dinh Q. Nguyen
(74) *Attorney, Agent, or Firm*—William N. Hogg

(57) ABSTRACT

A method and system for spraying scale conditioning aqueous solutions onto opposite sides of a metal strip for scale conditioning is provided. The system includes a housing which defines a chamber through which the moving strip passes on the strip pass line. A nozzle maintenance station is provided which is disposed off the strip pass line. Sets of spray nozzles are provided and the sets are independently movable between the maintenance station and spraying portion on opposite sides of the strip. Thus, each set can be utilized independently to spray a strip or be worked on in the maintenance station without shutting down the line.

27 Claims, 10 Drawing Sheets

SPRAY NOZZLE CONFIGURATION

RELATED APPLICATION

This invention is related to application Ser. No. 09/469,687, filed Dec. 22, 1999, entitled "Composition, Apparatus and Method of Conditioning Scale on a Metal Surface", commonly assigned (Docket No. KOL-10-5310), which is hereby incorporated by reference as if it has been fully set forth.

FIELD OF THE INVENTION

This invention relates generally to spray nozzle configurations and, more particularly, to the configuration and operation of spray nozzles for spraying scale conditioning solution onto a moving strip of heated metal.

BACKGROUND OF THE INVENTION

Scale conditioning in certain types of alloy steels, such as stainless steel and other types of alloys prior to actual pickling in order to condition the scale for easier removal is well known in the art. One conventional technique for scale conditioning is the use of fused salt baths normally comprised of a caustic, such as sodium hydroxide or potassium hydroxide, or mixtures thereof and preferably some type of oxidizing agent, such as sodium nitrate or potassium nitrate. In this conventional technique, the salt bath is fused and, in one embodiment, the moving strip of material as it emerges from an annealing furnace is submerged in the fused bath, wherein the chemical action of the fused salt conditions the scale and makes it more amenable to removal by a subsequent acid pickling which also is normally done in the line with the salt bath. In some cases, the scale conditioning by the salt bath may be sufficient of itself to remove scale, thus obviating the need for an acid pickle following the scale conditioning. However, in most instances, the acid pickle is required following the scale conditioning. In view of the occasional use of scale conditioning treatment itself for the removal of scale, this scale conditioning treatment is sometimes referred to as salt bath descaling even if followed by an acid pickle. Thus, the terms "scale conditioning" and "salt bath descaling" are often used interchangeable and synonymously.

While this fused salt bath technique of descaling is very efficient in many instances, it is somewhat expensive in that the bath must be maintained in a fused condition, requiring insulated tanks and heaters to maintain the bath in the fused condition. Moreover, because of drag-out and other factors, the amount of salt required for this scale conditioning is relatively high. Additionally, temperature and chemical resistant tanks are required and temperature and chemical resistant rolls are also required to be immersed in the salt bath to guide the strip therethrough, all adding to the expense of the line. Thus, while salt bath conditioning is an effective way to provide scale conditioning, in some instances the costs make it desirable to seek other techniques.

One technique that has been proposed to replace the fused salt bath is one in which a fused salt is sprayed onto the moving strip of steel as it emerges from the annealing furnace. This does provide some economic benefit. However, there are some drawbacks in certain instances to the spraying of fused salt onto a strip, such as the necessity to maintain the salt in a fused condition which means insulated tanks and energy to maintain the salt fused. Also, the temperature at which the salt is sprayed, together with the composition of the material sprayed tends to degrade the nozzle life for the nozzles being used to spray the fused salt. Such a technique is shown in U.S. Pat. No. 5,272,798, commonly assigned herewith. Other techniques have been developed for spraying salt onto a moving heated strip of material. In patent application Ser. No. 09/469,687, an aqueous solution of caustic material is sprayed onto a moving strip of material as it emerges from an annealing furnace. This application is incorporated herein by reference as if it were fully set forth. This technique has proved very successful over the fused salt bath technique and the technique of spraying of the fused salt onto the surface of the metal. However, as disclosed in that application, the nozzles are all in a relatively fixed position with respect to the strip in the pass line. Thus, if maintenance is required on any of the nozzles, the line must be shut down while such maintenance is performed. In some instances where there are frequent changes in gauge and/or composition and/or width of the material, this is not a significant problem. However, in some instances, it is desired to be able to continue to operate the line while repairing or replacing or doing any necessary maintenance on the nozzles because of the nozzles being clogged or otherwise ineffective, i.e. to service the nozzles without shutting down the line.

SUMMARY OF THE INVENTION

According to the present invention, a method and system for spraying scale conditioning aqueous solutions onto opposite sides of a metal strip for scale conditioning is provided. The system includes a housing which defines a chamber through which the moving strip passes on the strip pass line. At least one nozzle maintenance station is provided which is disposed off the strip pass line. A first set of spray nozzles is provided having a first array of nozzles mounted on a first nozzle mounting structure and a second array of nozzles mounted on a second nozzle mounting structure. An actuation mechanism is provided to move the first and second arrays of nozzles between a first position wherein the first array of nozzles is disposed on one side of the strip pass line in a spraying position, and the second array of nozzles is disposed on the opposite side of the strip pass line in a spraying position, and a second position wherein said first and second arrays of said nozzles are disposed at a nozzle maintenance station. A second set of spray nozzles is provided having a third array of nozzles mounted on a third nozzle mounting structure, and a fourth array of nozzles mounted on a fourth nozzle mounting structure, and an actuating mechanism to move said second set of nozzles between a first position, wherein said third array of nozzles is disposed on one side of said strip pass line in a spraying position and spaced from said first array of nozzles, and the fourth array of nozzles is disposed on the opposite side of said strip pass line in a spraying position, spaced from a second array of nozzles; and a second position wherein said third and fourth arrays of nozzles are disposed at a maintenance station.

In another embodiment, the nozzles of the first set can be composed of two separate sections mounted on opposite sides of the strip, with the combined sections covering the width of the strip in the spraying position. In this case, there is a nozzle maintenance station on each side of the strip.

The spraying can be accomplished with only one set of nozzles so, if any nozzle in one set or the other is clogged, that set of nozzles can be removed to the nozzle maintenance station and any work that needs to be done on the nozzle can be accomplished, including the replacement of any nozzle or any group of nozzles. This can be done while the line continues to run and the other set of nozzles is used to spray the solution on both sides of the strip as it continues to pass through the chamber. Preferably, both arrays of nozzles in each set are movable together and, preferably, there is one nozzle maintenance station and, preferably, the nozzle maintenance station is configured so that it can accommodate either set (but not both sets concurrently) of nozzles while the other set is deployed and operating.

The invention also contemplates sensing devices to sense when any given nozzle is not performing according to a preselected standard. In-line activities, such as providing a charge of compressed air to blow out any clogs in the nozzle while it is still deployed, may be provided.

The invention also contemplates providing shaping of the nozzle spray patterns on the strip so as to obtain optimum spray coverage.

The parameters of controlling the composition of the solution being sprayed, the concentration of the solution being sprayed, and the temperature of the strip, are all described in said application Ser. No. 09/469,687 and need not be repeated here, the present invention being related specifically to the spray nozzle configurations used for such spraying.

DESCRIPTION OF THE PREFERRED EMBODIMENTS

Figure 1:
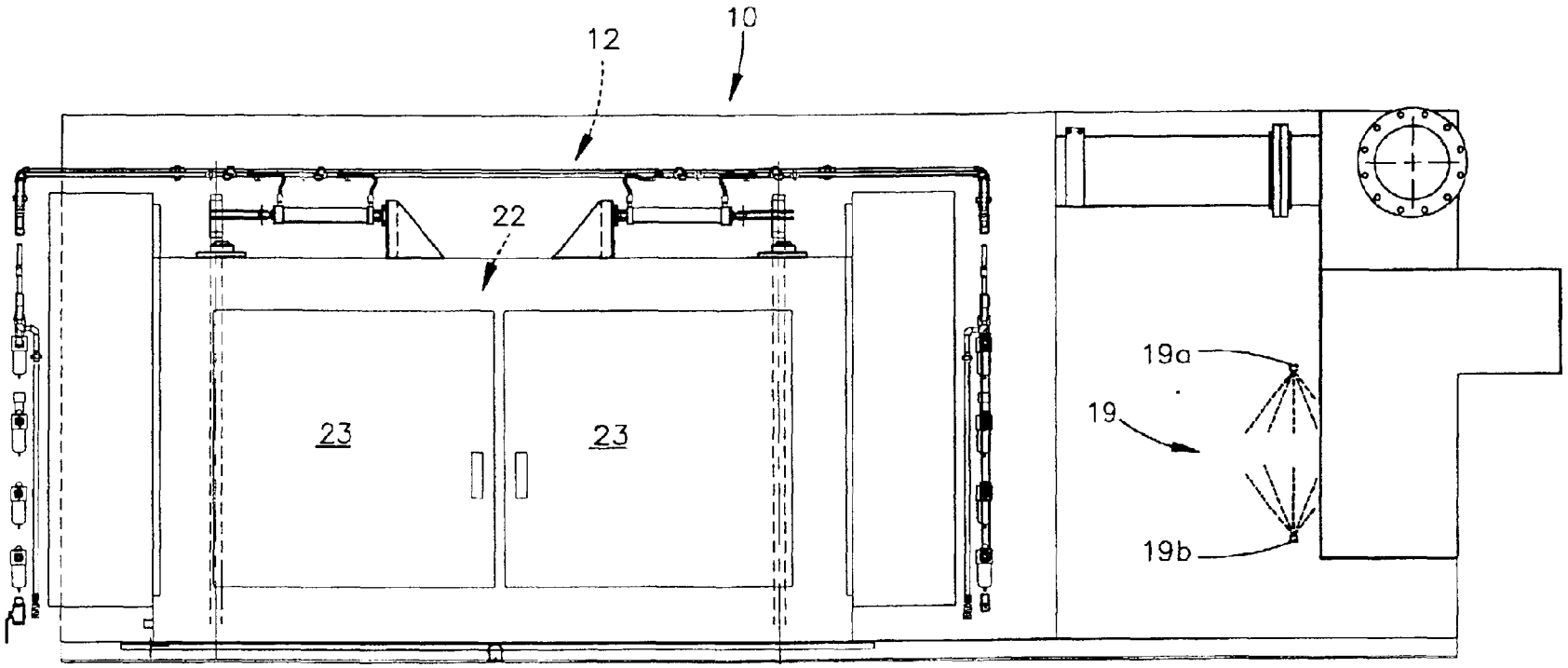
FIG. 1 is a side elevational view of the device of one embodiment of the present invention.

Before describing the invention in detail as shown in the drawings, a general overview of the present invention will be discussed.

As was indicated earlier, when spraying scale conditioning liquid onto a moving hot strip of material, such as disclosed in application Ser. No. 09/469,687, occasionally nozzles will become clogged for various reasons. As disclosed in said related application, there are back-up nozzles provided so that there are two separate and distinct sets. However, if nozzles in both sets become clogged, it becomes necessary to shut down the entire line in order to perform maintenance on the nozzles. This is expensive and can result in scrapped material and, thus, is something that is to be avoided. According to one embodiment of the present invention, this problem is overcome by providing two sets of nozzles, each set being movable separate and apart from the other set, from a spraying position to a nozzle maintenance station. Thus, if any of the nozzles in one set become clogged, these nozzles that are clogged can be moved to a maintenance station while the nozzles in the other set are continuing to spray the liquid, thus allowing maintenance on the clogged nozzles without the necessity of shutting down the line.

The preferred embodiment, to be discussed presently, describes two sets of nozzles, each set of nozzles having one array of nozzles arranged to spray liquid on one side of a moving strip and another array of nozzles of the same set to spray liquid on the other side of the strip. Moreover, in the preferred embodiment, the nozzles of each set are moved together as a unit. In other words, both arrays of nozzles, i.e. those that are on the top and bottom, are moved together between the spraying position and the position within the nozzle cleaning or maintenance station. However, it is to be understood that each array of nozzles could be moved between the positions independently;

Moreover, the preferred embodiment discloses an arrangement wherein the strip moves on a horizontal pass line and there is but a single maintenance station, and each set of nozzles is movable pivotally between the nozzle maintenance station and the spraying position. It is to be understood, however, that the strip could be moved on a vertical pass line and, in such a case, it may be desirable that the nozzle arrays be mounted for linear movement on either side of opposite sides of the strip pass line, rather than being mounted for pivotal movement. However, by using pivotal movement, a single maintenance station can be provided whereas, if the nozzles are moved laterally, a nozzle maintenance station for each set of nozzles, i.e. each set of arrays of nozzles for spraying the opposite sides of the strip, requires a separate nozzle maintenance station.

In another embodiment, each set of nozzles can be controlled by two sections; each rotationally mounted on opposite sides of the strip and the combined sections covering the width of the strip for spraying.

The important feature of the present invention, however, is that each set of nozzles can be moved independently of the other set and can be moved from the spraying position to the maintenance station while maintaining the production of the strip by using the other set of nozzles.

Of course, it is to be understood that if further redundancy is required, additional sets of nozzles could be provided with additional maintenance stations. However, normally two sets of nozzles are sufficient to allow for proper nozzle maintenance while maintaining the production from the other set of nozzles because both sets of nozzles would not require maintenance at the same time.

Referring now to the drawings, and for the present to FIG. 1, a structure for spraying scale conditioning liquid onto a moving strip of material, such as stainless steel or the like, is shown. This structure receives a steel strip from an external source of material, such as an annealing furnace at one end, after which it has been cooled to the appropriate temperature and then passes through the spraying structure and emerges from the opposite end. The process is described in said application Ser. No. 09/469,687, and it is to be understood that a structure of the present invention can be substituted for the spraying section of the invention as described in said application Ser. No. 09/469,687. Since this application has been incorporated herein by reference and since the present invention is related to the spraying device per se and not to any process or material being sprayed, it is not believed necessary to show the various aspects of the invention, other than the structure used for spraying the liquid onto the material. The preferred material being sprayed is that disclosed in said application Ser. No. 09/469,687 and the temperatures at which it is sprayed and the concentrations thereof also are as disclosed in said application Ser. No. 09/469,687.

As can be seen in FIGS. 1, 2A, 2B and 2C, the present invention includes a structure 8 defining an internal chamber 10 which includes a strip treating section 12. The structure 8 includes an entrance opening 14 at one end through which the strip enters, and an exit opening 16 at the opposite end through which the strip exits. The strip is generally maintained on a strip pass line 18 so that the proper liquid can be sprayed on opposite sides of the strip. A spray/rinse section 19 is optionally provided at the end of the strip treating section 12. An upper spray nozzle 19*a* is provided to spray water on the top of the strip S as it emerges from the treating section 12. A lower spray nozzle 19*b* is provided to spray the underside of the strip S.

Figure 4:
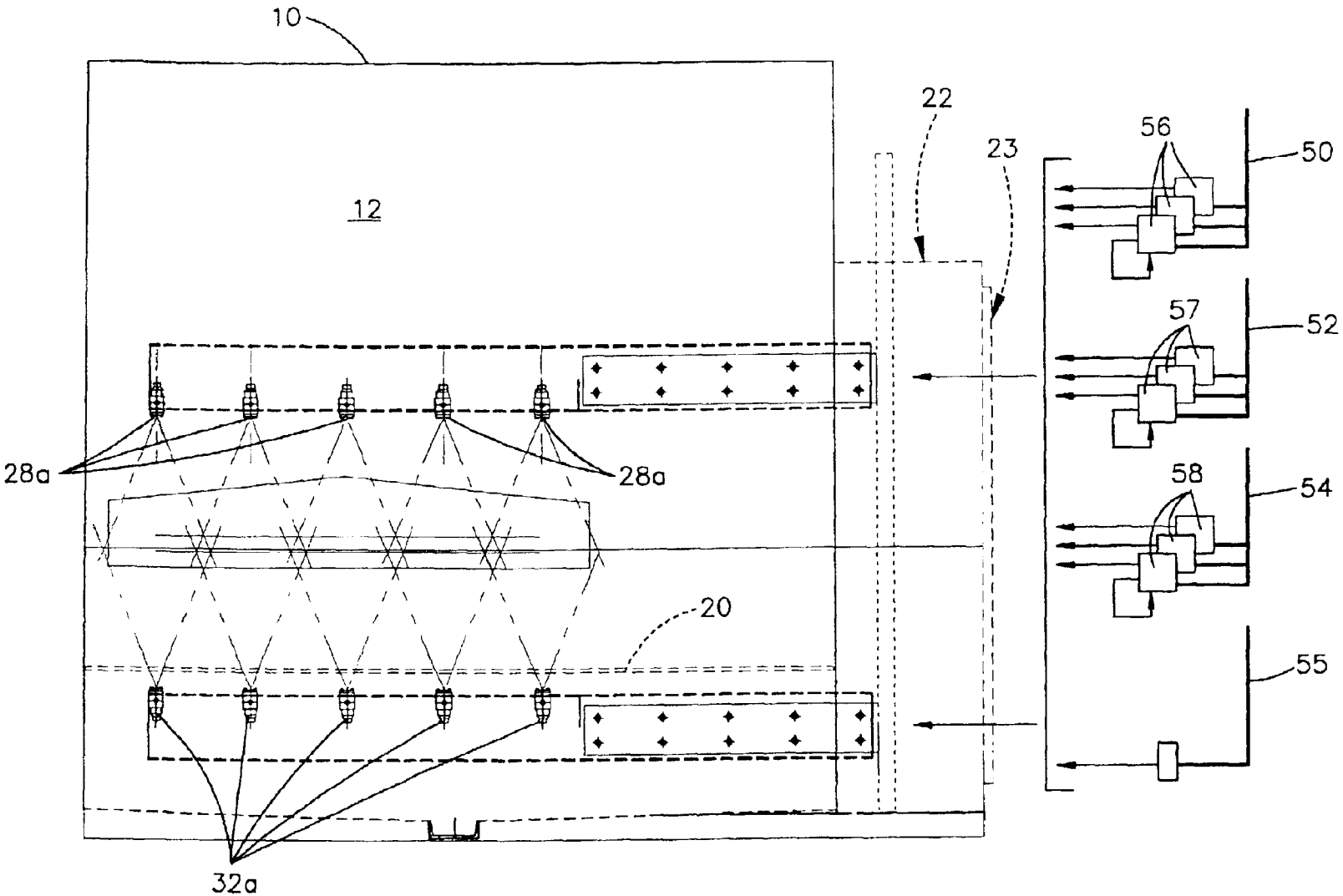
FIG. 4 is an end elevational view showing the strip passing through the structure with the upper and lower arrays of nozzles of the first set of nozzles spraying onto the strip.
Figure 5:
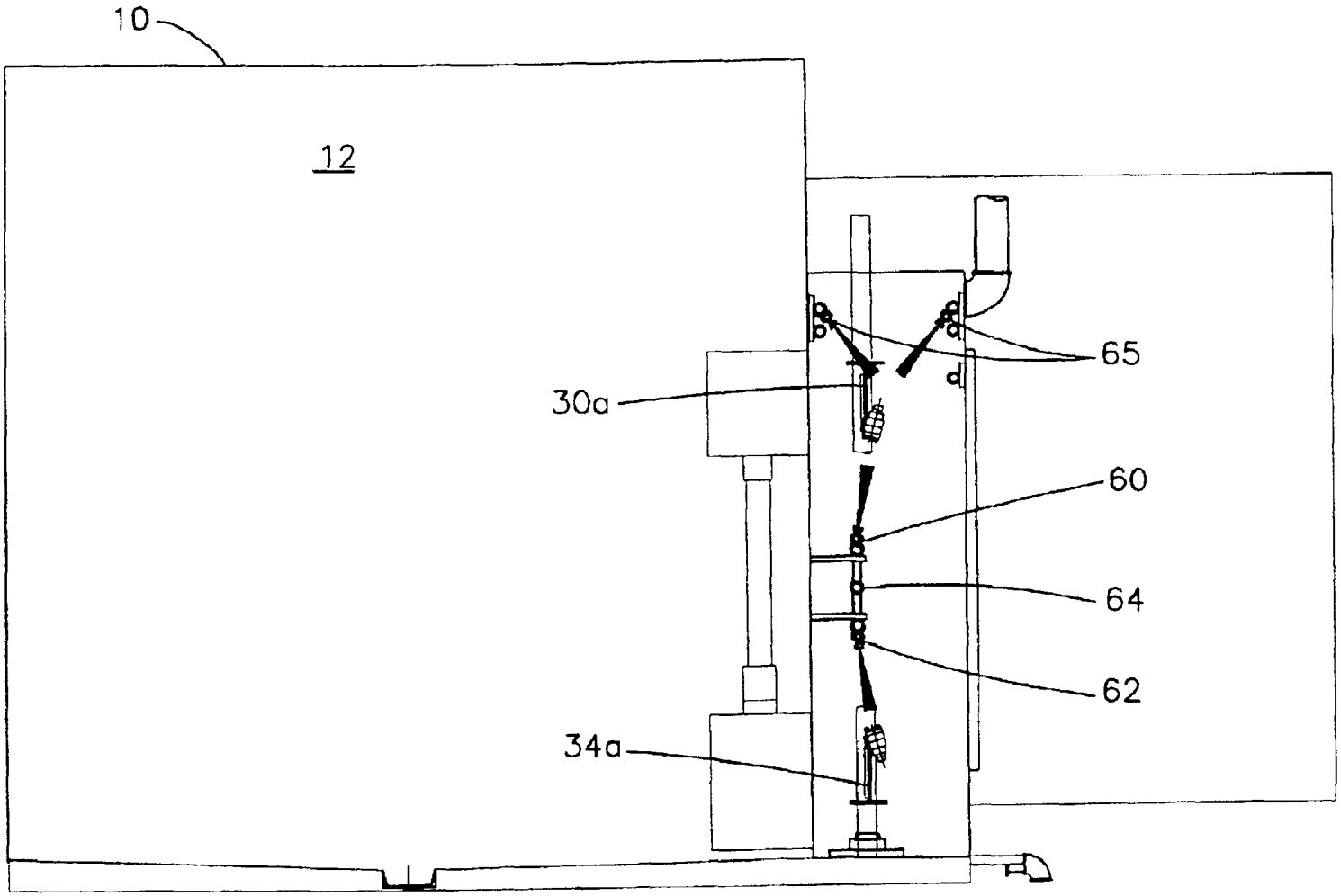
FIG. 5 is a somewhat diagrammatic view of some of the cleaning nozzles in the nozzle maintenance station showing the third and fourth arrays of the second set of nozzles being cleaned.

A plurality of supports 20, shown in FIG. 4, are provided so that if a strip is temporarily stopped or sags during processing, it will have a support on which to rest so as not to damage the lower array of nozzles in each set, as will be described presently.

The structure 8 also defines a nozzle maintenance station 22, between which nozzle maintenance station 22 and the chamber 10, the nozzles can be moved, as will be described presently. A pair of entrance doors 23 provide access to the nozzle maintenance station 22 and, if desired, a movable closure or strip of flexible material (not shown) can be used to isolate the maintenance station 22 from the strip treating section 12, to protect any personnel from spray while working on the nozzle(s) in the maintenance station 22

Figure 2A:
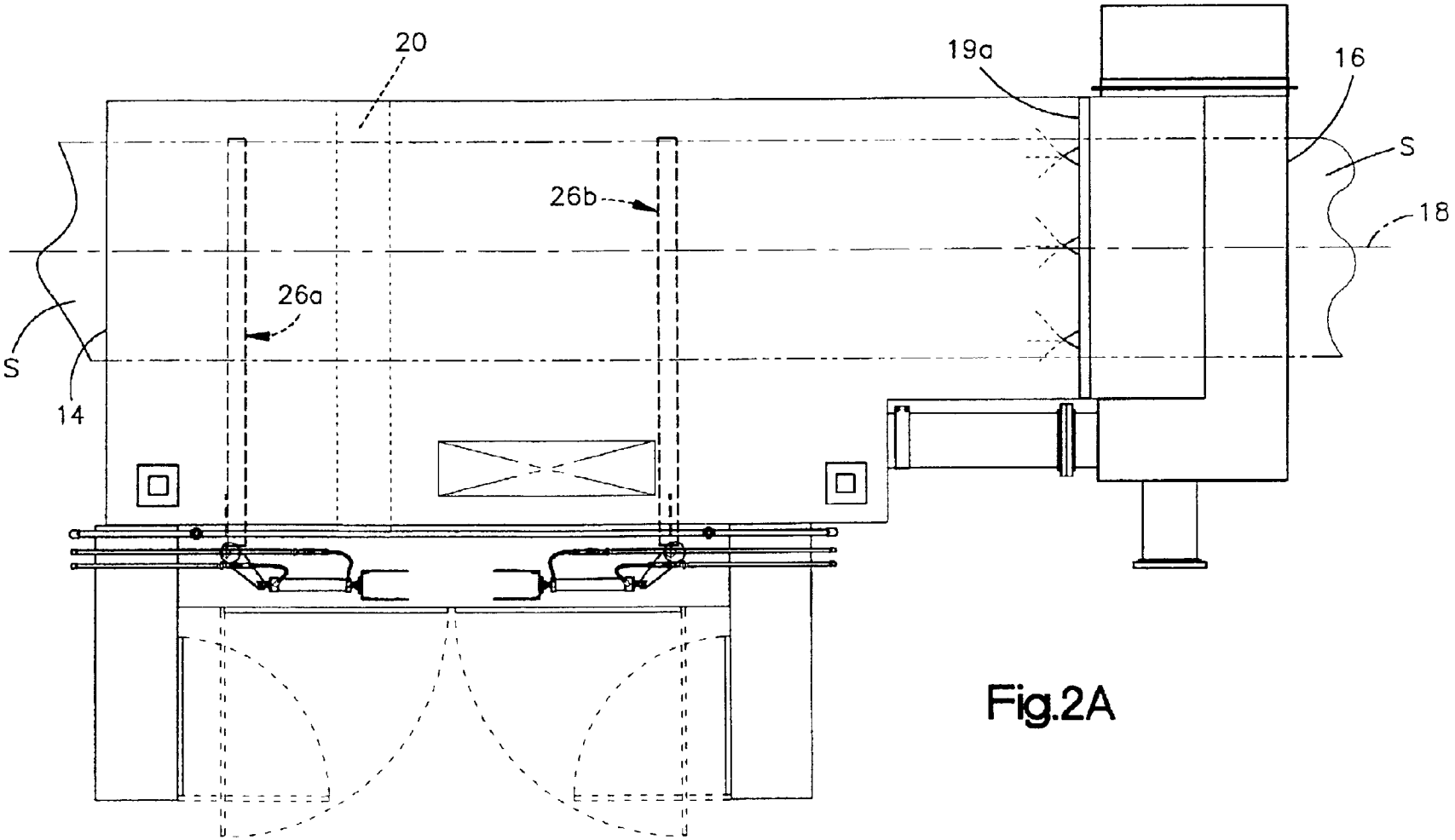
FIG. 2A is a top view showing both sets of nozzles in the spraying position.
Figure 2B:
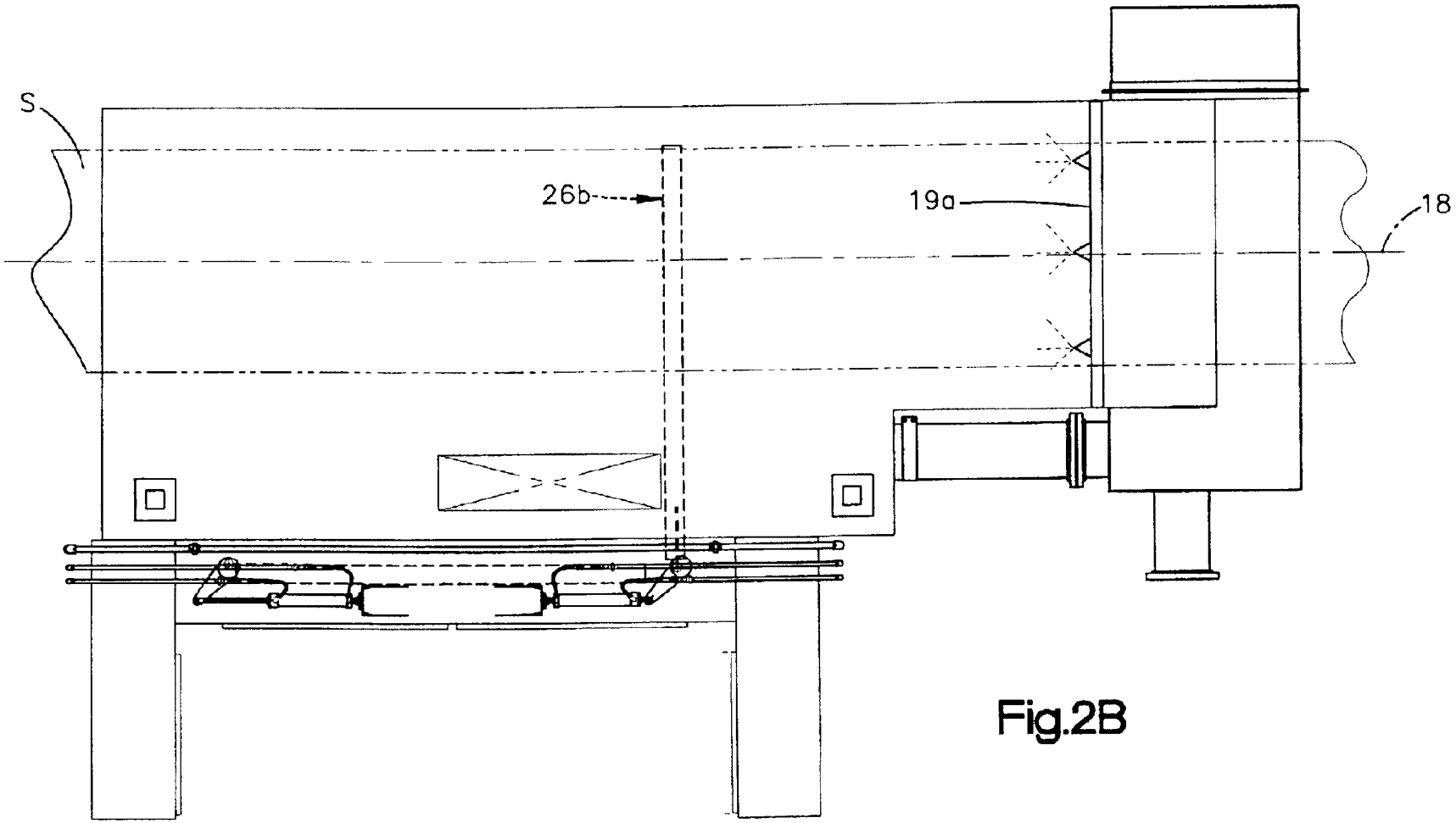
FIG. 2B is a view similar to FIG. 2A showing only one set of nozzles in the spraying position, with the other set of nozzles being in the cleaning position.
Figure 2C:
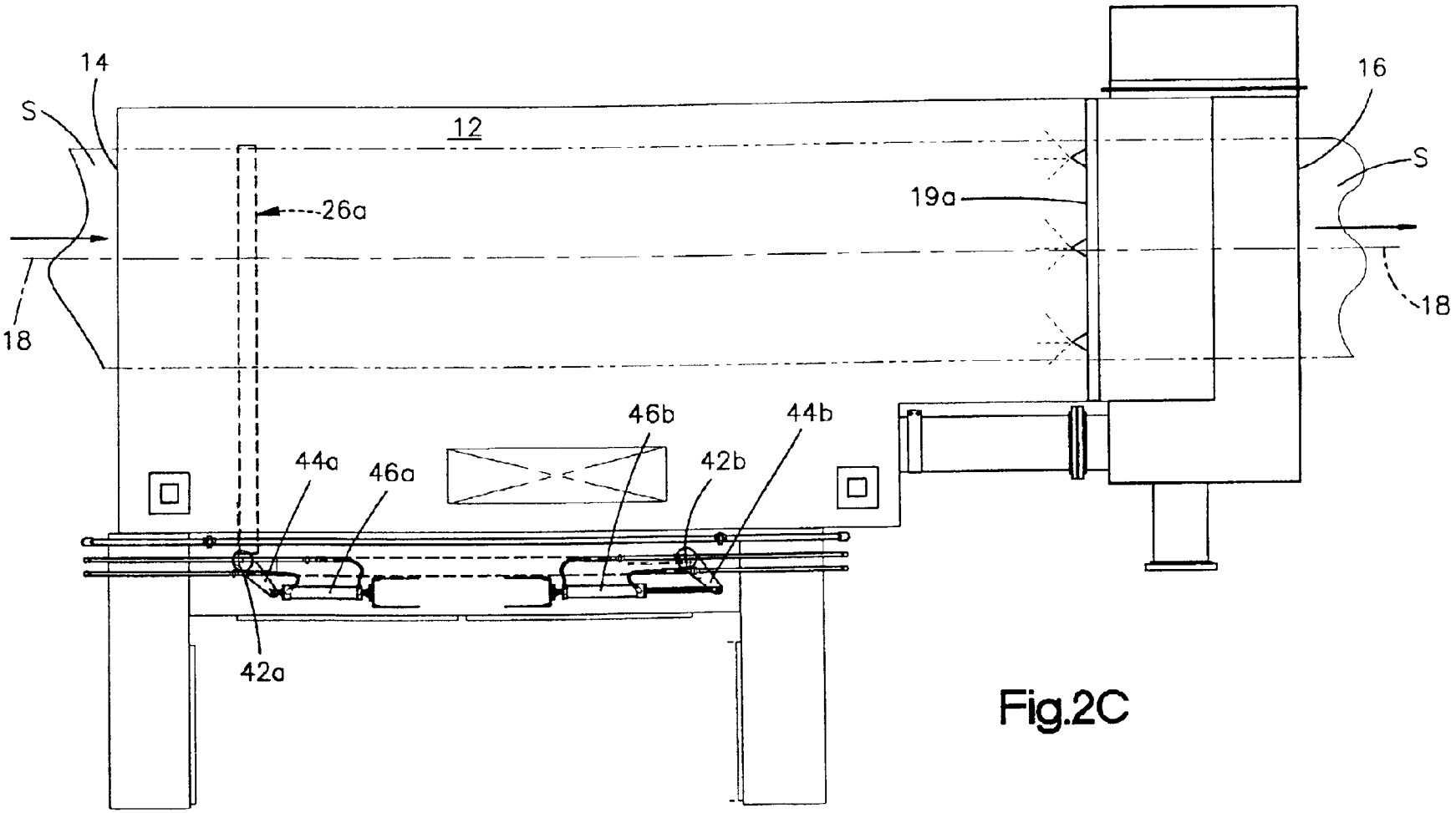
FIG. 2C is a view similar to FIG. 2B but with the other set of nozzles in the spraying position and the first set of nozzles in the nozzle maintenance station.
Figure 3A:
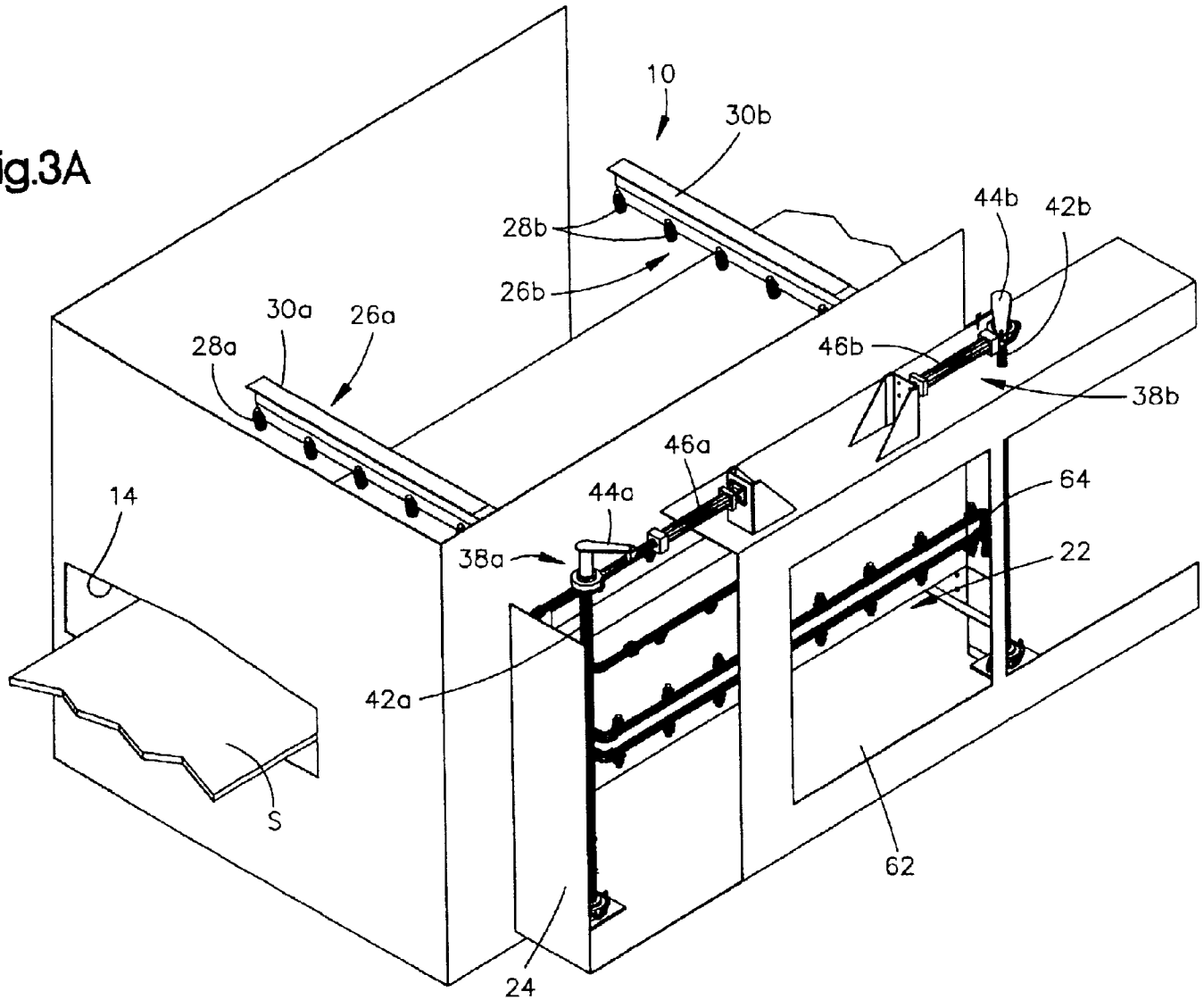
FIG. 3A is a perspective view with parts broken away for clarity, somewhat diagrammatic, showing both sets of nozzles in the spraying position.
Figure 3B:
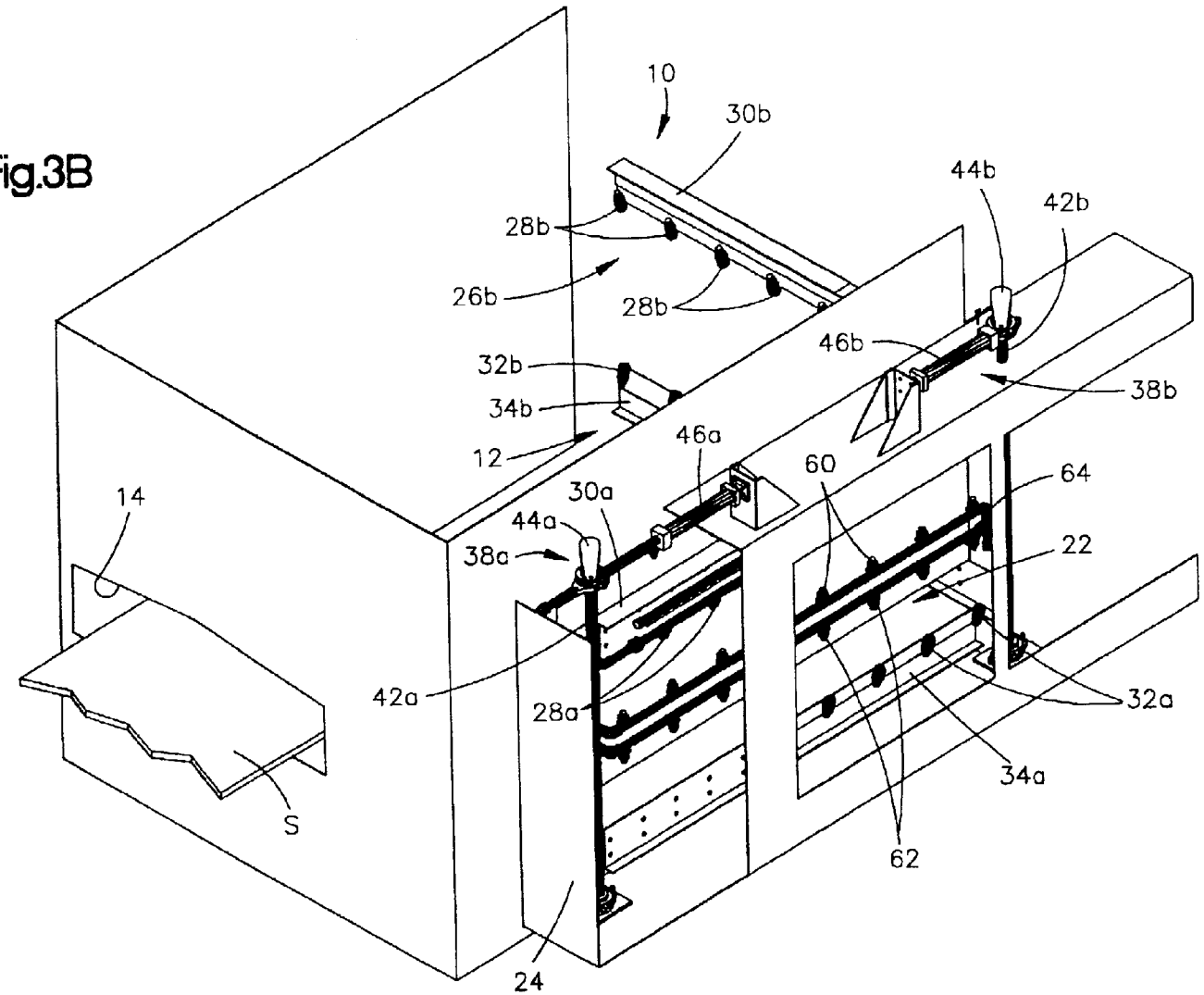
FIG. 3B is a view similar to FIG. 3A but with only one set of nozzles in the spraying position.
Figure 3C:
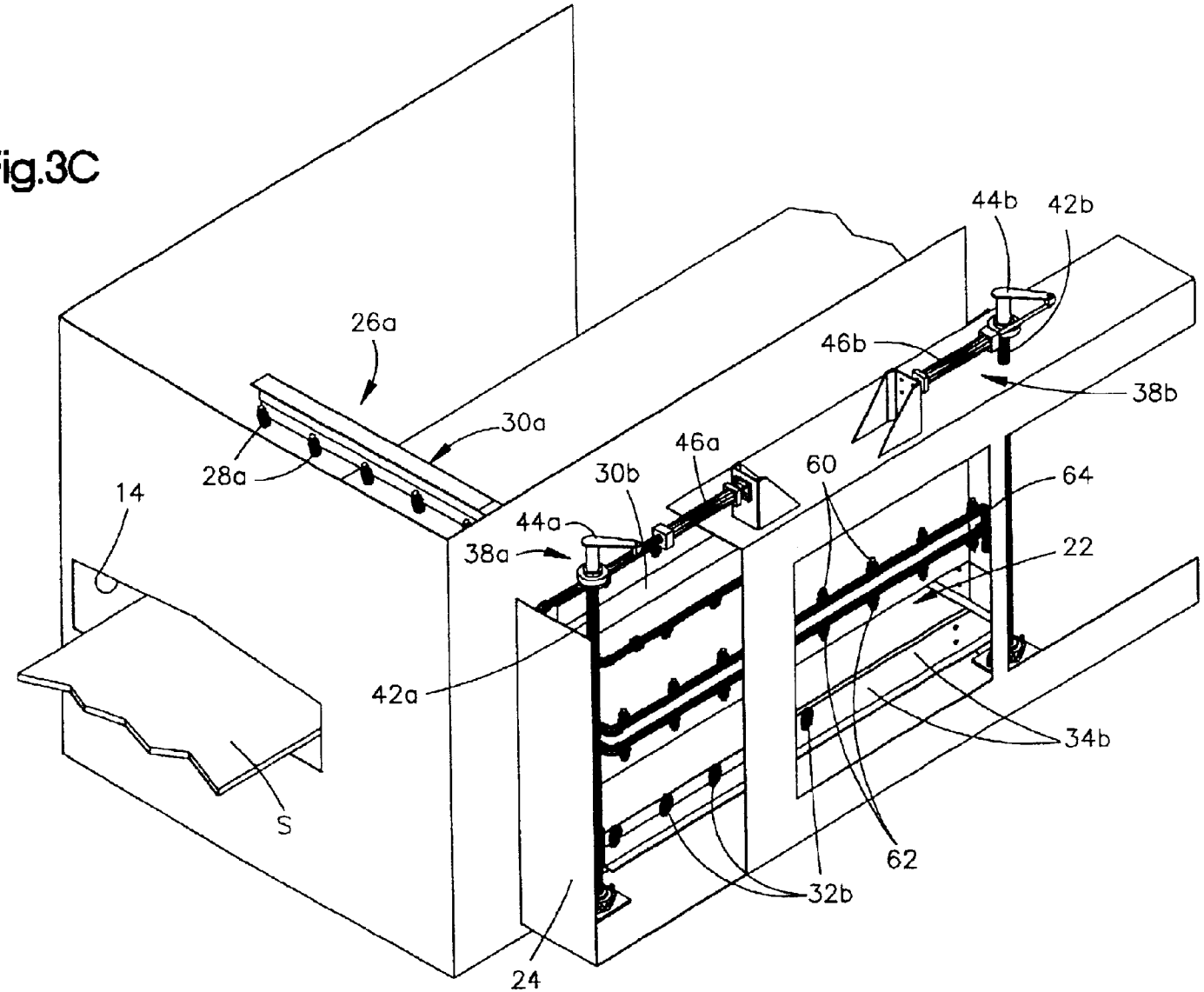
FIG. 3C is a view similar to FIG. 3B but with the other set of nozzles in the spraying position, and the first set in the cleaning position.

A nozzle arm support structure 24 is provided (see FIGS. 3A, 3B and 3C). The nozzle arm support structure 24 supports a first set of nozzles 26*a* which includes a first array of nozzles 28*a* mounted on a first array nozzle support arm 30*a*, and a second array of nozzles 32*a* mounted on a second nozzle array support arm 34*a*. The support structure also supports a second set of nozzles 26*b*, which includes a third array of nozzles 28*b* mounted on a third nozzle support arm 30*b* and a fourth array of nozzles 32*b* mounted on a fourth nozzle array support arm 34*b*. Each of the sets of nozzles 26*a* and 26*b* are movable independently between a spraying position, as shown in FIGS. 2A and 3A, when they are both in the spraying position in strip treating section 12, or to the position shown in FIGS. 2B and 3B when the set of nozzles 26*a* is in the position located in the nozzle maintenance station 22, and set 26*b* is in the spraying position in treating section 12, and in FIGS. 2C and 3C where the set of nozzles 26*a* is in the spraying position in treating section 12 and the set of nozzles 26*b* is in the nozzle maintenance station 22.

The set of nozzles 26*a* is mounted on a nozzle actuating mechanism 38*a* which has a post 42*a*, a crank arm 44*a* and an actuating cylinder 46*a* which will pivot the set of nozzles 26*a* between the spraying position and the position in the nozzle maintenance station 22. Similarly, the set of nozzles 26*b* is mounted on an actuating mechanism 38*b* mounted on a crank arm 44*b* and an actuation cylinder 46*b* which is actuatable to move the second set of nozzles 26*b* between the position where it is spraying on a strip in treating section 12 and the nozzle maintenance station 22. Preferably, each of the nozzles is of the internal flat spray atomizing nozzle type manufactured and sold by Spraying Systems Company of Wheaton, Ill.

As shown somewhat schematically in FIG. 4, one fluid delivery line 50 is for the delivery of the liquid descaling solution that is to be used to spray on a strip, one fluid delivery line 52 is for compressed air to atomize the descaling liquid at the nozzles. Optionally, fluid delivery line 54 delivers air for shaping the shape of the spray. Alternatively, fluid line 55 delivers compressed air on demand to actuate plunger mechanisms in the nozzles to remove nozzle tip blockages.

Figure 6:
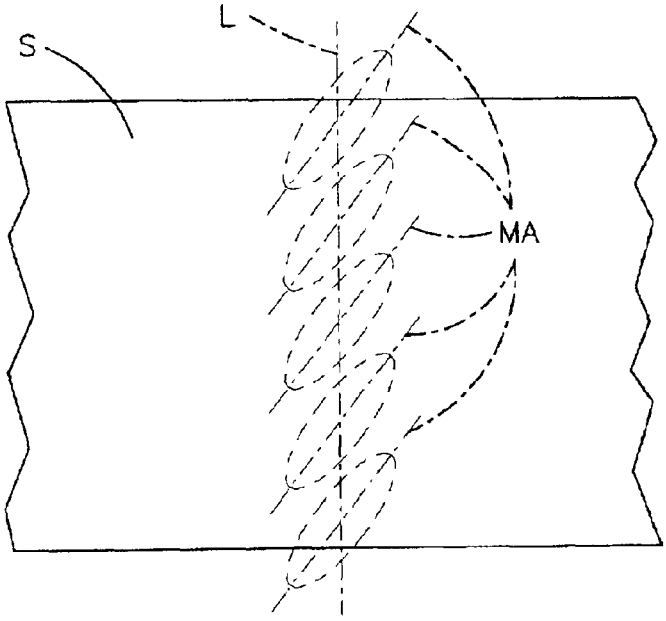
FIG. 6 is a diagrammatic view of the spray pattern of one of the arrays of nozzles directed onto a strip.

The pattern sprayed by each nozzle is shown in FIG. 6. The nozzles of each array are arranged so that in the spraying position they form a line L transverse to the direction of the path of travel of the strip on the strip path. The pattern from each nozzle is an elliptical pattern. The major axis MA of the ellipse is at an acute angle with respect to the line L.

It is to be understood that monitoring control mechanisms 56, 57 and optionally 58 are provided to position and control the spray from each nozzle and also to monitor the pressure in each nozzle of the material being sprayed and/or the flow rate, and to indicate if there is a deficiency in the flow or error in the pattern. This will allow the set having malfunctioning nozzle(s) 26*a*, 26*b* to be moved from the spraying position to the nozzle maintenance station 22. In the nozzle maintenance station, as shown in FIGS. 3A–3C and 5, there are upper arm cleaning nozzles 60, lower arm cleaning nozzles 62, and a fluid supply line 64 to supply these nozzles with cleaning fluid. Preferably, the cleaning fluid is merely warm water which, for the present application, will normally clean any clogged materials out of the nozzles. Air may also be blown onto the nozzles from fluid head 65 to dry the nozzles in the nozzle maintenance section. In this embodiment, only one set of cleaning nozzles 60 needs to be provided for the array of nozzles 28*a* and 28*b* on nozzle support arms 30*a* and 30*b*, and one set of nozzles 62 for the array of nozzles 32*a* and 32*b* on the nozzle support arms 34*a* and 34*b*.

Thus, in operation, the cleaning apparatus can normally maintain both the first set of nozzles 26*a* and the second set of nozzles 26*b* in the position where they can be used to spray solution onto the strip, as shown in FIGS. 2A and 3A. Normally, only one set of nozzles, e.g. 26*a*, will be designated as a primary, and the other set of nozzles, e.g. 26*b*, will be designated as redundant; however, either set 26*a* or 26*b* could be either primary or redundant and, in fact, the primary set could alternate between primary and redundant if one wished. In any event, normally it is not required to have spraying from both sets of nozzles. Thus, if any nozzle in any one set of nozzles becomes clogged or otherwise malfunctions, the spray can be immediately transferred to the other set of nozzles, and the set having the clogged or malfunctioning nozzle(s) can be pivoted to the nozzle maintenance station 22 and the cleaning nozzles 60 and 62 actuated to clean all of the nozzles in that particular set. In any event, one set of nozzles 26*a* or 26*b* can be spraying while the other set is in the nozzle maintenance station 22. In fact, if the spray washing of the nozzles by the cleaning nozzles 60 and 62 in the nozzle maintenance station 22 is not effective to clean the nozzle and injecting air does not overcome the problem, each nozzle can be individually replaced and, thus, the first set of nozzles or second set of nozzles, as the case may be, can be returned to the actuating condition so that they are operative.

Figure 7:
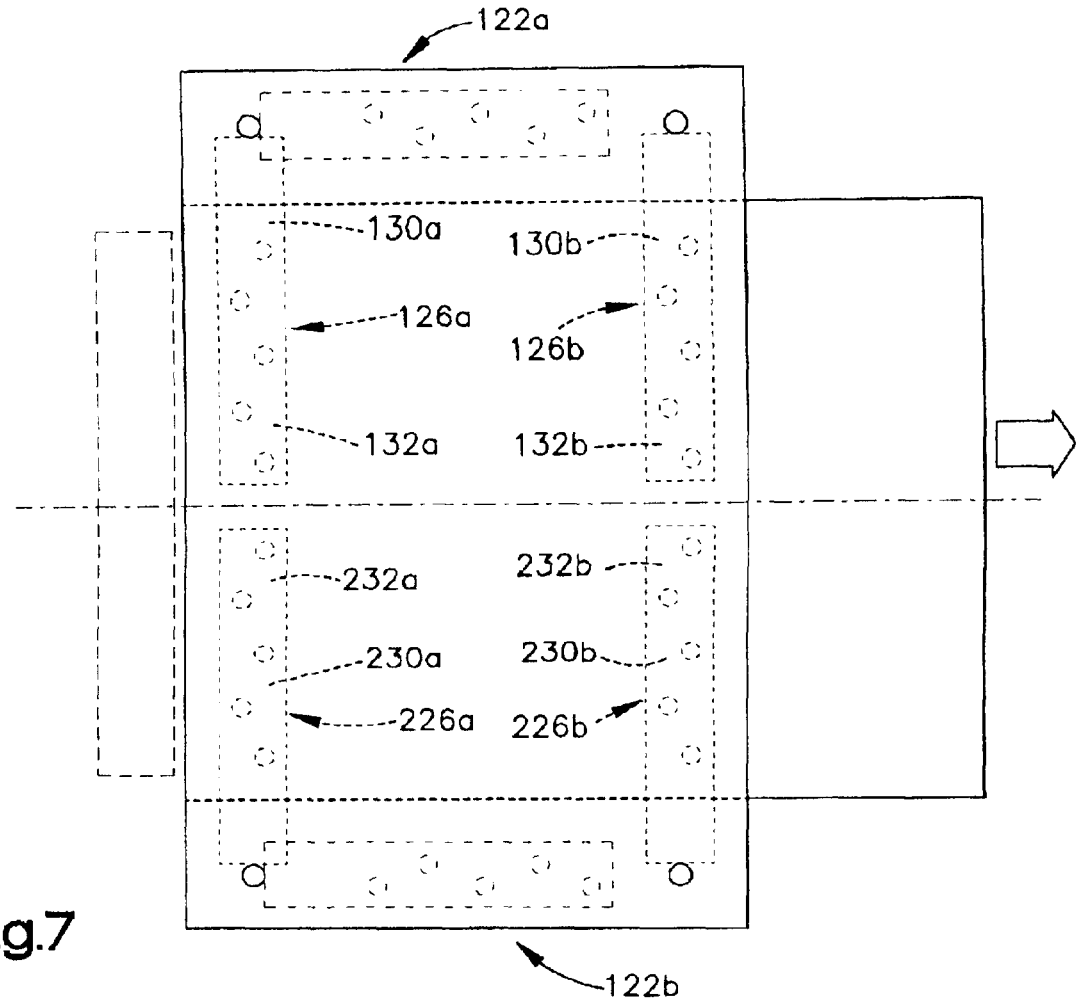
FIG. 7 is a top elevational view of another embodiment of the invention.

In another embodiment, as shown in FIG. 7, the first and second sets of nozzles shown as 26*a* and 26*b* in the previous embodiment are each composed of two sections 126*a* and 226*a* and 126*b* and 226*b*. Each section of each set has a nozzle support arm 130*a*, 230*a*, 132*a*, 232*a*, 130*b*, 230*b*, 132*b* and 232*b* and support arrays of nozzles 128*a*, 228*a*, 128*b* and 228*b*, respectively. The arms 130*a* and 132*a* and 130*b* and 132*b* can be rotated into nozzle maintenance station 122*a*, and arms 230*a*, 232*a*, 230*b* and 232*b* can be rotated into nozzle maintenance station 122*b*. Thus, stations 122*a* and 122*b* function just as nozzle maintenance station 22 functions. The section of nozzles 126*a*, 226*a*, 126*b* and 226*b* can each function independently.

Accordingly, the preferred embodiments of the present invention have been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

What is claimed is:

1. A spraying system for spraying scale conditioning liquid on opposite sides of a moving strip of metal comprising:

a housing defining a chamber through which the moving strip passes on a strip pass line;

at least one nozzle maintenance station disposed off of the strip pass line;

a first set of spray nozzles having a first array of nozzles mounted on a first nozzle mounting structure, a second array of nozzles mounted on a second nozzle mounting structure, and an actuation mechanism to move said first set of nozzles between (a) a first position wherein said first my of nozzles is disposed on one side of said ship line, and said second array of nozzles is disposed on the opposite side of said strip pass line; and (b) a second position wherein said first and second arrays of said nozzles are disposed at a nozzle maintenance station;

a second set of spray nozzles having a third array of nozzles mounted on a third nozzle mounting structure, and a fourth array of nozzles mounted on a fourth nozzle mounting structure, and an actuating mechanism to move said second set of nozzles between (c) a first position wherein said third array of nozzles is disposed on said one side of said strip pass line and spaced from said first array of nozzles, and said fourth array of nozzles is disposed on said opposite side of said strip pass line from said second array of nozzles, and (d) a second position wherein said third and fourth array of nozzles are disposed at a nozzle maintenance station.

2. The invention as defined in claim 1 wherein each nozzle maintenance station includes facilities for spraying liquid on said nozzles disposed in said nozzle maintenance station.

3. The invention as defined in claim 2 wherein each nozzle maintenance station includes facilities for drying a portion of said nozzles disposed in said nozzle maintenance station.

4. The invention as defined in claim 1 wherein each nozzle of each said array of nozzles is independently replaceable.

5. The invention as defined in claim 1 wherein said sprayed liquid from each nozzle has an asymmetric spray pattern with a major and minor axis.

6. The invention as defined in claim 5 wherein the nozzles in each array define a line that is essentially transverse to the strip pass line when in said first position, and the major axis of the spray pattern of said sprayed liquid is at an acute angle with respect to a line lying on the strip pass line transverse to the direction of travel of the strip.

7. The invention as defined in claim 1 wherein each of said first and second nozzle mounting structures is pivotally mounted for moving to said first and second positions.

8. The invention as defined in claim 1 wherein each of said first and second nozzle mounting structures is retractably mounted for moving to said first and second position.

9. The invention as defined in claim 1 wherein each of said first and second nozzle mounting structures is reciprocally mounted for moving to said first and second positions.

10. The invention as defined in claim 1 characterized by a sensing device control structure associayed with each nozzle to actuate nozzle cleaning action upon sensing of a given condition.

11. The invention as defined in claim 10 wherein said sensing device associated with each nozzle senses diminished or lack of liquid spray.

12. The invention as defined in claim 1 further characterized by a control device operationally connected to each of said nozzles to selectively purge the nozzle with a cleaning liquid.

13. The invention as defined in claim 1 wherein the actuating mechanism is configured to move each of said arrays of nozzles between said first and second positions independently of each other array.

14. The invention as defined in claim 1 wherein said actuating mechanism to move the first and arrays of nozzles is connected to move both arrays together, and said actuating mechanism to move said third and fourth arrays of nozzles is connected to move both third an fourth arrays together.

15. A method of spraying scale conditioning liquid on opposite sides of a moving strip of metal comprising the steps of:

providing a housing defining a chamber through which the moving strip passes on a strip pass line;

providing at least one nozzle maintenance station disposed off of the strip pass line;

providing a first set of spray nozzles having a first array of nozzles mounted on a first nozzle mounting structure, and a second array of nozzles mounted on a second nozzle mounting structure, and an actuating mechanism to move said first set of nozzles between (a) a first position wherein said first array of nozzles is disposed on one side of said strip pass line, and said second array of nozzles is disposed on the opposite side of said strip pass line; and (b) a second position wherein said first and second arrays of said nozzles are disposed in a nozzle maintenance station;

a second set of spray nozzles having a third array of nozzles on a third nozzle mounting structure, and a fourth array of nozzles mounted on a fourth nozzle mounting structure, and an actuating mechanism to move said second set of nozzles between (c) a first position wherein said third array of nozzles is disposed on said one side of said strip pass line and spaced from said first array of nozzles, and said fourth array of nozzles is disposed on said opposite side of said strip pass line spaced from said second array of nozzles, and (d) a second position wherein said third and fourth array of nozzles are disposed at a maintenance station;

normally maintaining at least one set of spray nozzles in said first position; and periodically moving each array of spray nozzles to said second position while the nozzle arrays in the other set are positioned in the first position.

16. The invention as defined in claim 15 wherein each nozzle maintenance station includes facilities for spraying liquid on said nozzles disposed in said nozzle maintenance station, and said nozzles are sprayed with said cleaning liquid in said maintenance station.

17. The invention as defined in claim 16 wherein each nozzle maintenance station includes facilities for drying at least some of said nozzles disposed in said nozzle maintenance station.

18. The invention as defined in claim 15 wherein the nozzles of each array of nozzles are independently replaceable.

19. The invention as defined in claim 15 wherein said sprayed liquid from each nozzle has an asymmetric spray pattern with a major and minor axis.

20. The invention as defined in claim 19 wherein the nozzles in each array define a line that is essentially transverse to the strip pass line when in said first position, and the major axis of the spray pattern of said sprayed liquid is at an acute angle with respect to a line lying on the strip pass line transverse to the direction of travel of the strip.

21. The invention as defined in claim 15 wherein each of said first and second nozzle mounting structure is pivotally mounted for moving to said first and second positions.

22. The invention as defined in claim 15 wherein each of said first and second nozzle mounting structures is retractably mounted for moving to said first and second positions.

23. The invention as defined in claim 15 wherein each of said first and second nozzle mounting structures is reciprocally mounted for moving to said first and second positions.

24. The invention as defined in claim 15 characterized by a sensing device and control structure associated with each nozzle to actuate nozzle cleaning action upon sensing of a given condition.

25. The invention as defined in claim 15 further characterized by selectively purging each nozzle with a cleaning liquid responsive to a sensed condition thereof.

26. The invention as defined in claim 15 wherein each of said arrays is moved between its first and second positions independently of each other array.

27. The invention as defined in claim 15 wherein said first and second arrays of nozzles constituting the first set of spray nozzles are movable together, and said third and fourth arrays of nozzles constituting the second set of spray nozzles are movable together.

* * * * *

UNITED STATES PATENT AND TRADEMARK OFFICE

CERTIFICATE OF CORRECTION

PATENT NO. : 6,776,359 B2
DATED : August 17, 2004
INVENTOR(S) : John M. Cole and James C. Malloy It is certified that error appears in the above-identified patent and that said Letters Patent is hereby corrected as shown below:

Column 8,
Line 37, after "and", insert -- second --;
Line 40, after "third", change "an" to -- and --.

Signed and Sealed this

Thirtieth Day of November, 2004

JON W. DUDAS
*Director of the United States Patent and Trademark Office*